US006293289B1

(12) United States Patent
Hapke et al.

(10) Patent No.: US 6,293,289 B1
(45) Date of Patent: Sep. 25, 2001

(54) SURGE PRESSURE VENT FOR LOW NOISE DISHWASHER

(75) Inventors: Kenyon A. Hapke, Libertyville, IL (US); Joel C. Bragg, Waterford, WI (US)

(73) Assignee: Ark-Les Corporation, Stoughton, MA (US)

( * ) Notice: Subject to any disclaimer, the term of this patent is extended or adjusted under 35 U.S.C. 154(b) by 0 days.

(21) Appl. No.: 09/435,654

(22) Filed: Nov. 8, 1999

(51) Int. Cl.[7] ..... A47L 15/42

(52) U.S. Cl. ..... 134/58 D; 134/95.2; 134/200; 312/213

(58) Field of Search ..... 134/56 D, 57 D, 134/58 D, 95.2, 183, 200, 201; 312/213, 214, 400

(56) References Cited

U.S. PATENT DOCUMENTS 4,247,158 * 1/1981 Quayle ..... 134/200 X
5,572,869 11/1996 Schantz et al. ..... 60/528
5,660,195 * 8/1997 Taylor, Jr. et al. ..... 134/58 D
5,836,324 * 11/1998 Johnson et al. ..... 134/58 D
6,138,692 * 10/2000 Kobos et al. ..... 134/58 D X

FOREIGN PATENT DOCUMENTS

2937589 * 4/1981 (DE) ..... 134/56 D

* cited by examiner

*Primary Examiner*—Philip R. Coe
(74) *Attorney, Agent, or Firm*—Quarles & Brady, LLP

(57) ABSTRACT

A vent for a dishwasher provides a valve with dual actuation, either to be electrically actuated according to a cycle of the dishwasher so as to close during periods of high noise generation, typically the wash cycle, and opened during the dry cycle, or to be actuated independently of the cycle under pressure differences such as may be caused by interruption of the dishwasher cycle and opening and closing of the dishwasher door such as may cause a pressure surge as the introduced cool air is rapidly heated in the interior of the dishwasher.

11 Claims, 5 Drawing Sheets

SURGE PRESSURE VENT FOR LOW NOISE DISHWASHER

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to automatic dishwashing machines (dishwashers) and in particular to a dishwasher providing for low noise operation.

Dishwashers, such as those found in many homes, provide a closable chamber holding one or more racks into which eating utensils and cookware may be placed for cleaning. The chamber may include a door, opening to the front of the chamber to allow easy loading and unloading of the chamber, and closing, during a washing cycle, to prevent the escape of water which is sprayed within the volume of the chamber to wash the items placed in the racks.

Upon completion of the washing cycle, a drying cycle is initiated in which water is drained from the enclosure and moist air is discharged through an upper vent. Cool air pulled into the chamber through a lower vent rapidly dries the heated dishes.

Dishwashers can be quite noisy during the washing cycle, the noise coming from the agitated water, movement of the dishes, and the dishwasher mechanism of the water pump and motor. Some of this noise can be reduced by properly shrouding the chamber and dishwasher mechanism with sound absorbing materials. Nevertheless, a considerable amount of noise can still escape from even a properly shrouded chamber through the vents. Even a small vent area can allow a significant amount of noise to escape by diffraction.

One method of reducing noise escaping through the vent is to construct a vent which may close during the washing cycle and then open once the agitated water and pumping action has ceased to allow for proper drying of the dishes. Unfortunately, such closable vents can create a problem when the user interrupts the washing cycle to add a forgotten item for cleaning. When the dishwasher door is opened to insert the additional item, the chamber's volume of heated, moist air is replaced by colder air from the room. When the dishwasher door is reclosed, the hot dishes, racks and walls of the dishwasher together with the agitating hot water quickly heat the cold air causing it to expand. This expansion can force water from the dishwasher out through the door leading the user to believe the dishwasher has malfunctioned.

BRIEF SUMMARY OF THE INVENTION

The present inventors have recognized that a low noise vent for a dishwasher can be produced by properly combining an electrically actuated valve with a pressure actuated valve. The electrically actuated valve may be closed during the washing cycle and opened during the drying cycle, whereas the pressure actuated valve may provide relief of the surge pressure generated when the wash cycle is interrupted and started again.

Importantly, the pressure actuated valve may respond at an arbitrary time in the washing cycle independent of the cycle timer of the dishwasher while the electrically actuated valve may respond during the drying cycle when no triggering change in pressure occurs.

Specifically, then, the present invention provides a noise reducing vent for use with a dishwasher, the vent having an electrically actuated valve positioned to block passage of air from the sealable volume of the dishwasher to the outside of the dishwasher in a closed state and to allow the passage of air from the sealable volume to the outside of the dishwasher in an open state, the electrically actuated valve moving between the open and closed state in response to an electrical signal. The electrically actuated valve is combined with a pressure actuated valve positioned to block the passage of air from the sealable volume to the outside of the dishwasher in a closed state and to allow the passage of air from the sealable volume to outside the dishwasher in an open state, the pressure actuated valve moving from the closed to the open state in response to a predetermined excess of air pressure in the sealed volume over the air pressure outside the dishwasher.

It thus is one object of the invention to provide a vent that can be closed to reduce noise emitted from a dishwasher in response to normal cycle timing of the dishwasher and yet which prevents over-pressure of the sealed volume of the dishwasher such as may occur after interruptions of the washing cycle when the door of the dishwasher is opened.

The electrically actuated valve may employ a wax motor moving a valve element to cover or uncover an aperture leading between the sealable volume and outside of the dishwasher.

Thus it is another object of the invention to permit the use of an inexpensive yet slower wax motor for opening and closing the valve during the expected changes between cycles of the dishwasher while allowing response to extremely fast and unexpected pressure fluctuations caused by interruption of the washing cycle.

The predetermined pressure at which the pressure-actuated valve is triggered may be set to less than one inch of water.

Thus it is another object of the invention to provide a vent which actuates to rapidly suppress low surge pressures that might otherwise be sufficient to expel water from water traps that are used in some dishwashers to block air inlet vents during the washing cycle.

The pressure-actuated valve may be a caged ball seatable against a circular aperture leading between the sealable volume and the outside of the dishwasher. Alternatively, the pressure-actuated valve may include at least one flap hinged to movably cover an aperture leading between the sealable volume and outside the dishwasher.

Thus it is another object of the invention to provide extremely simple and robust valve mechanisms that may be pressure actuated at very low pressures.

The vent may include a common housing providing a first opening to the sealable volume and a second opening to outside the dishwasher, the first and second openings separated by a wall having a first and second aperture, each associated with one of the electrically actuated valves and pressure-actuated valves.

Thus it is another object of the invention to provide an integral vent unit such as may be mounted in the door of the dishwasher or the like.

The housing may include a second wall opposed to the first aperture having a third aperture therein and the electrically actuated valve may include a flexible boot having a valve surface sized to block the first aperture when the electrically actuated valve is actuated to block the first aperture, the flexible boot having side walls extending from the valve surface to an edge attached at the third aperture.

Thus it is another object of the invention to provide an electrically actuated valve that may be shielded from all contact material from the sealable volume of the dishwasher.

The foregoing and other objects and advantages of the invention will appear from the following description. In the description, reference is made to the accompanying drawings which form a part hereof, and in which there is shown by way of illustration, a preferred embodiment of the invention. Such embodiment does not necessary represent the full scope of the invention, however, and reference must be made to the claims herein for interpreting the scope of the invention.

DETAILED DESCRIPTION OF THE INVENTION

Figure 1:
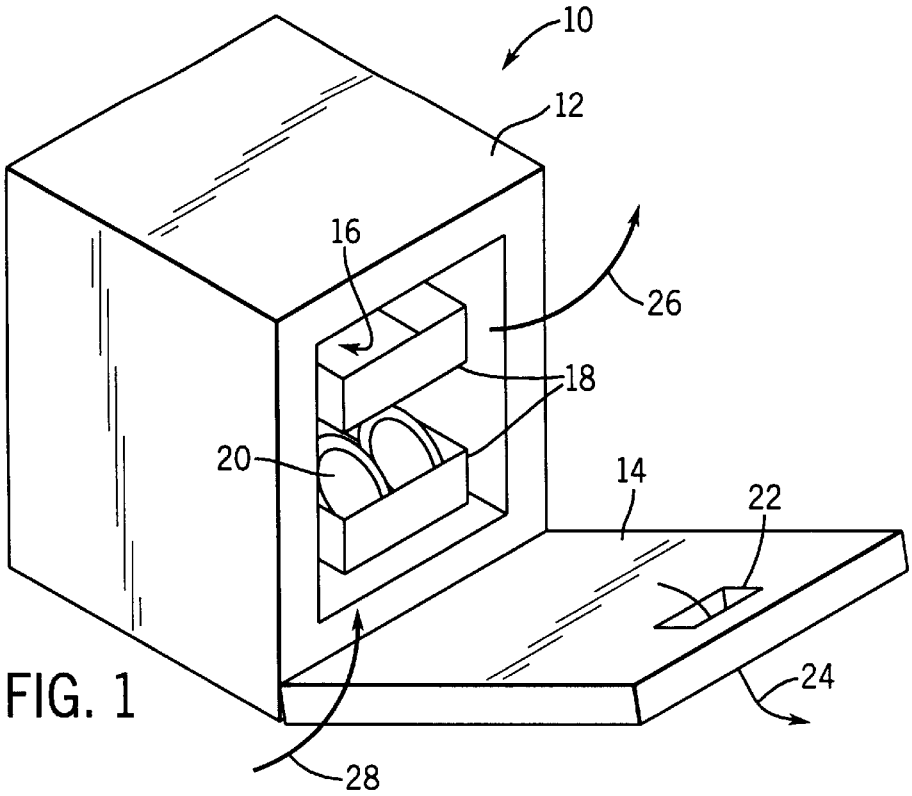
FIG. 1 is a simplified perspective view of a residential dishwasher showing the flow of cold and hot air into and out of the dishwasher when the washing cycle is interrupted and showing a vent path through the dishwasher door.

Referring now to FIG. 1, a dishwasher 10 includes a generally rectangular cabinet 12 open at the front but sealable by a hinged door 14 at that opening to define an enclosed volume 16. The volume 16 may hold one or more racks 18 to support dishes 20 or other items to be washed. The door 14 may include a vent 22 allowing passage of steam and air from the enclosed volume 16 to the outside of the dishwasher 10 as indicated by arrow 24.

Figure 2:
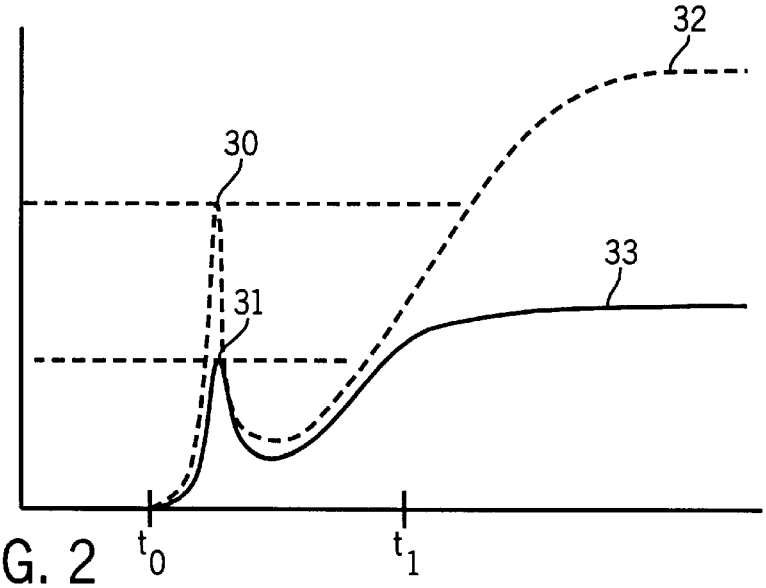
FIG. 2 is a graph plotting pressure versus time after a closing of the door of a dishwasher after interrupting of the washing cycle of the dishwasher of FIG. 1 with the vent path closed to reduce noise and further showing resultant surge pressure as is reduced by the present invention.

Referring now to FIGS. 1 and 2, when the door 14 of the dishwasher 10 is opened as shown in FIG. 1 after initiation of the dishwashing cycle, heated air 26 escapes from the volume 16 to be replaced by cooled air 28 from the room. As shown in FIG. 2, when the door 14 is closed again at time to and if the vent 22 is closed to reduce sound level outside of the dishwasher 10, then a rapid pressure spike 30 occurs caused by the heating of the air held within the enclosed volume 16 by the already warmed dishes 20 and walls of the volume 16. At time $t_1$, when agitation of hot water is resumed, the pressure rises to a spike 32 that may be sufficient to force water from the volume 16 past the door 14.

Figure 3:
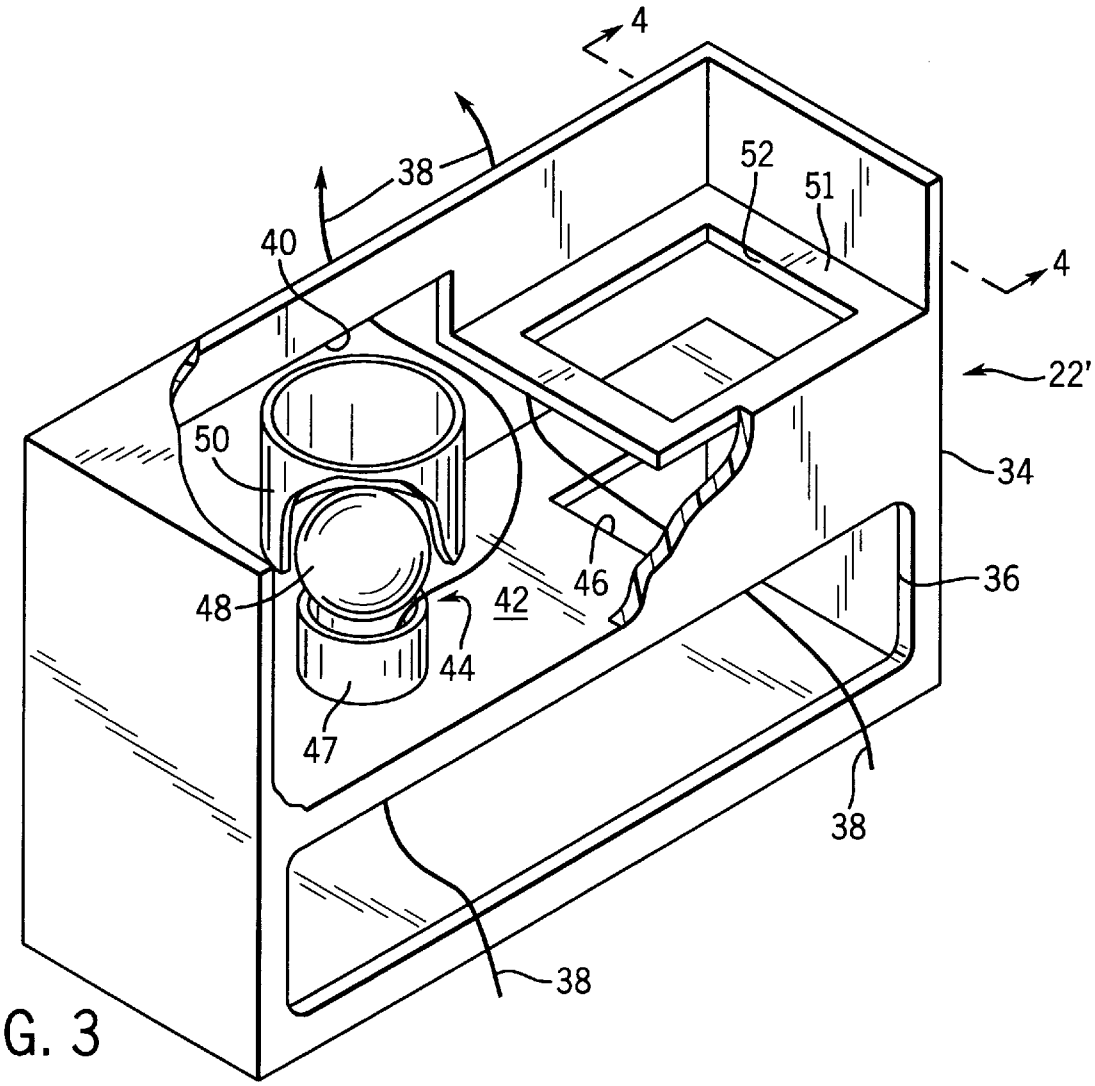
FIG. 3 is a perspective cutaway view of a first embodiment of the present invention showing a housing providing a first aperture separating the inside and outside of the dishwasher, the first aperture provided with a ball and cage valve in an open state, the housing also providing a second aperture for use with an electrically actuated valve not shown in FIG. 3.

Referring now to FIG. 3 for this reason, the present invention provides a vent 22, having a housing 34 such as may be a generally rectangular, parallelepiped having a first opening 36 communicating with the sealable volume 16 of the dishwasher 10 to allow the passage of air and steam 38 into the housing 34. A second opening 40 in the housing 34 communicates directly with the air outside of the dishwasher 10 allowing the passage of air and steam 38 from the housing 34 out to the outside air.

Dividing the interior volume of the housing 34 is a wall 42 such as may be positioned horizontally and which has two apertures 44 and 46 cut therein. Air and steam 38 flowing into the first opening 36 must pass through one of apertures 44 and 46 so as to continue and flow out through opening 40.

A ring-shaped valve seat 47 encircles aperture 44. On the top edge of the valve seat a lightweight ball 48 may rest. The upper half of the ball is encircled by a cylindrical cage 50 preventing the ball from moving substantially off of the axis of the valve seat 47.

When the pressure of the air within the volume 16 of the dishwasher 10 is substantially equal to or less than the ambient pressure, the ball 48 rests on the valve seat 47 sealing aperture 44 and preventing the escape of sound through the aperture 44. Alternatively, when the pressure within the volume 16 rises such as in pressure spike 30 and 32 shown in FIG. 2, the ball rises allowing passage of air and steam 38 through aperture 44.

The size and weight of the ball 48 and the area of the valve seat 47 may be adjusted so that this pressure threshold occurs at approximately one inch of water. Accordingly, referring again to FIG. 2, the pressure spikes 30 and 32 are reduced to levels 31 and 33 insufficient to eject water from the volume 16 of the dishwasher 10. Instead, pressurized air and steam 38 will overcome the weight of the ball 48 and pass through the aperture 44 to escape out opening 40.

Figure 4:
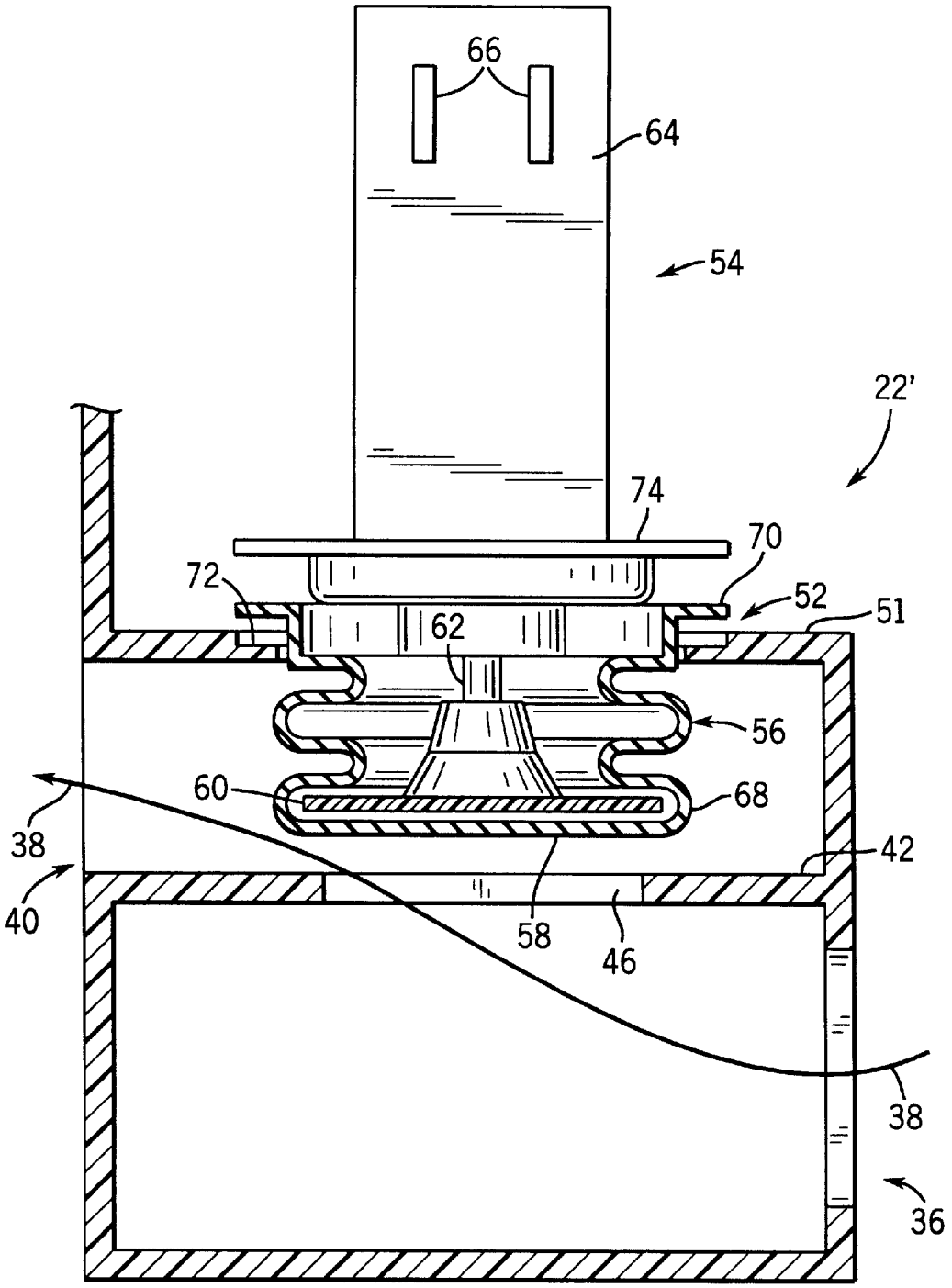
FIG. 4 is a cross-section along line 4—4 of FIG. 3 showing the electrically actuated valve as may be positioned on the second aperture of FIG. 3 per the present invention.

Referring now to FIGS. 3 and 4, positioned across from the wall 42 and aperture 46, is parallel wall 51 having an aperture 52 coaxial with aperture 46. Wall 51 serves to support electrically actuated valve 54 (shown only in FIG. 4). The electrically actuated valve 54 includes a flexible boot 56 having a generally planar valve surface 58 sized to block the aperture 46 when the valve surface 58 is pressed against aperture 46 thereby obstructing the flow of air and steam 38. The valve surface 58 is pressed against aperture 46 (or withdrawn therefrom) by a plunger 60 fitting within the boot 56 and adjacent to an inner side of valve surface 58 opposite the aperture 46. The plunger 60 in turn connects to a shaft 62 of a wax motor 64. Operating according to well-known principals, the wax motor 64 moves the shaft 62 toward the aperture 46 when electrical current is conducted through terminals 66 of the wax motor 64 to heat an internal element (not shown), melt a contained wax material causing expansion of that material against the shaft 62. The terminals 66 are connected to a cycle timer (not shown) of conventional design to provide current during the wash cycle and thereby to close the aperture 46 during that time of high noise generation. It will be understood from this description that an inverted logic may also be used in which the presence of current from the cycle timer opens the aperture 46 or wherein a bi-state mechanism is adapted where current alternately opens then closes the aperture 46.

The boot 56 has upwardly extending sidewalls 68 terminating at a radially extending flange 70, the latter which fits into a depressed rim 72 ringing the aperture 52.

It will be understood that the depressed rim 72 is not required and that flange 70 could sit on top of wall 51. A corresponding flange plate 74 on the wax motor 64 sandwiches the flange 70 between the depressed rim 72 and the flange plate 74 sealing the boot against the wall 51 and protecting the wax motor 64 from water and steam 38. The flange plate 74 also serves to support the wax motor 64 against the wall 51.

Figure 5A:
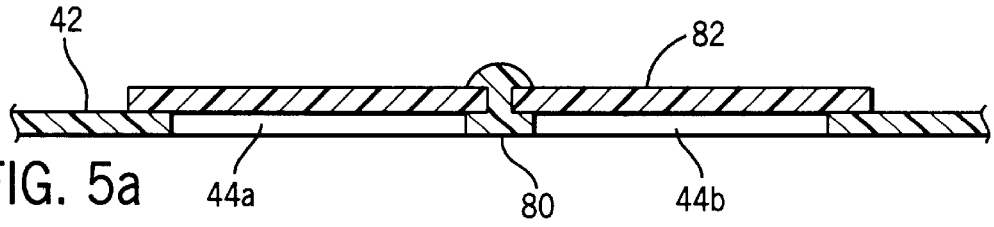
FIGS. 5*a* and 5*b* are alternative embodiments of the pressure actuated valve of FIG. 3 in which an elastomeric flap is used to cover apertures leading between the inside and outside of the dishwasher, FIG. 5*a* showing the valve in the closed state and FIG. 5*b* showing the valve in the open state.
Figure 5B:
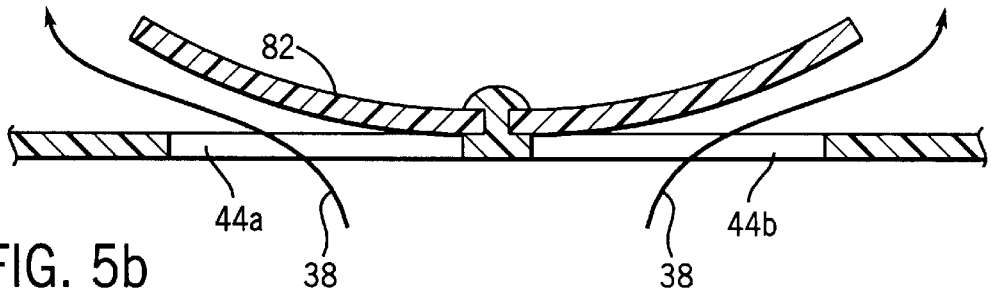

Referring to FIGS. 5*a* and 5*b*, the pressure actuated valve need not be limited to the ball and cage design shown in FIG. 3 but may include generally any well known pressure actuated valve including diaphragm, umbrella, and flapper valves known in the art. In one such alternative embodiment, aperture 44 is separated into two portions 44*a* and 44*b* as divided by diametric support bar 80. An elastomeric flap 82 is attached at its center to the diametric support bar 80 to extend over the apertures 44*a* and 44*b* and in a relaxed state to lie horizontally atop wall 42 sealing in noise. Pressure from air and steam 38 above a designated threshold, as shown in FIG. 5*b*, causes an upward flexing of the edges of the elastomeric flap 82 away from the apertures 44*a* and 44*b* allowing passage of air and steam therethrough. The weight and elasticity of the flap 82 and the area of the apertures 44*a* and 44*b* may be adjusted so as to provide an arbitrary pressure threshold for opening and the necessary clear aperture when the flap 82 does open. The ability to subdivide the aperture 46 allows great flexibility in the selection of different elastomeric interior materials.

Figure 7:
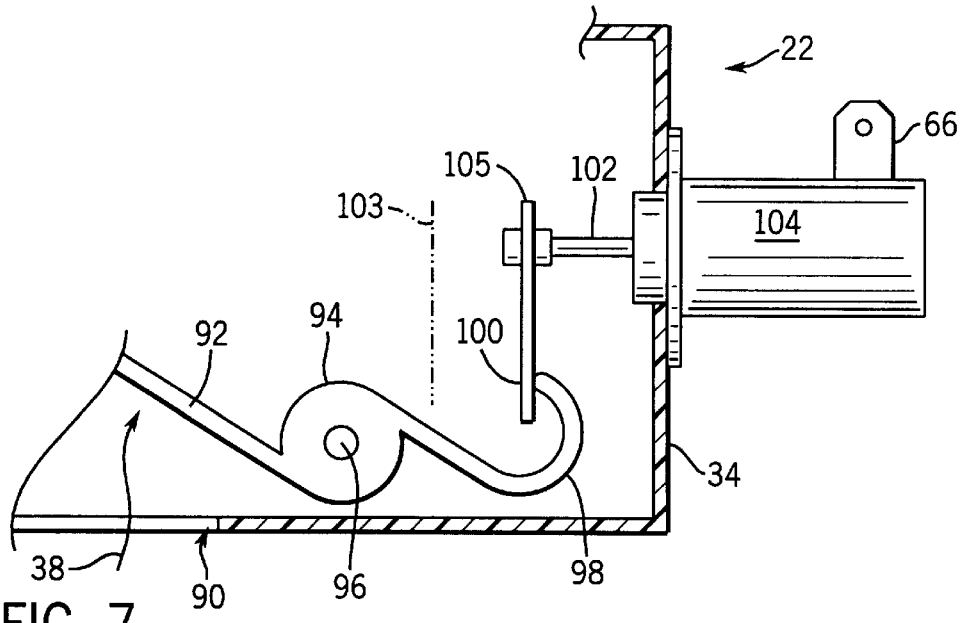
FIG. 7 is a fragmentary cross-sectional along line 7—7 of FIG. 6 showing operation of the alternative embodiment of FIG. 6.
Figure 6:
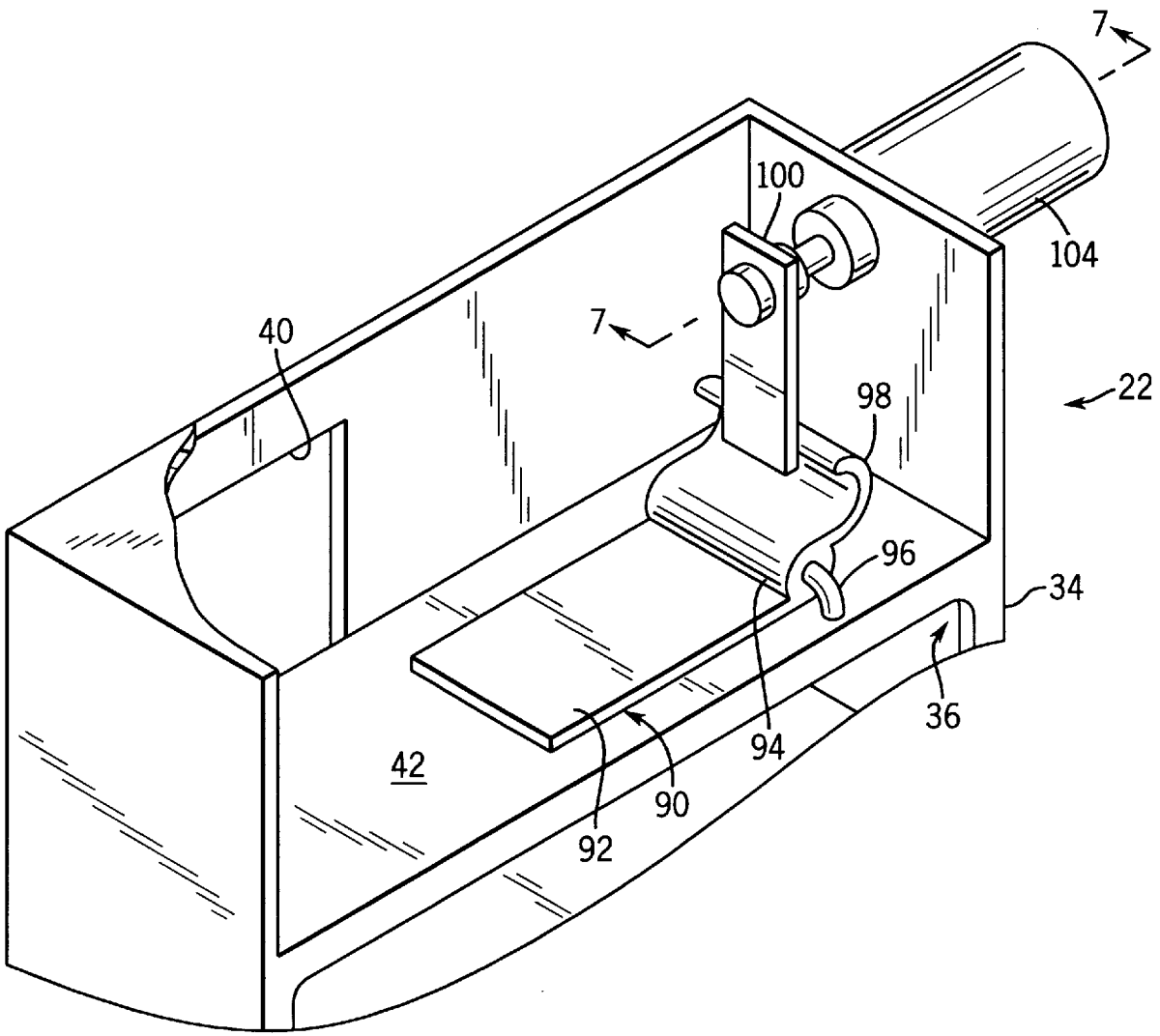
FIG. 6 is a fragmentary figure similar to FIG. 3 showing an alternative embodiment with integrated pressure and electrically actuated valves.

Referring now to FIGS. 6 and 7 in an alternative embodiment, the separate pressure actuated valve formed by ball 48 and valve seat 47, operating to open and close aperture 44, and electrically actuated valve 54 operating to open and close aperture 46, (all shown in FIG. 3) may be combined so that only a single aperture 90 is cut within wall 42 providing a single path through wall 42 between openings 36 and 40.

The aperture 90 may be covered by a generally rectangular flap 92 lying in a closed state atop wall 42 over aperture 90 and hinged at one end by knuckle 94 supported by horizontally opposed pintels 96 so that the flap 92 may rotate about the knuckle 94 and rise away from aperture 90 under the same excess pressure conditions that lift ball 48 from valve seat 47 (shown in FIG. 3). In this regard, the weight of the flap 92 is adjusted to provide for similar pressure relief as provided by ball 48 and seat 47 or flap 82 and aperture 44.

Extending oppositely from knuckle 94 away from flap 92 is a hook 98 curving upward from wall 42 so as to be behind downwardly extending finger 100 attached to shaft 102 of wax motor 104. When current is not provided to the wax motor 104, the downward finger 100 moves from a first position 103 to a second position l05 engaging hook 98 to raise flap 92 away from aperture 90. When the wax motor 104 receives current, the downward extending finger 100 returns to the first position 103 in which hook 98 does not engage downward finger 100 allowing for the full range of motion of the flap 92 between open and closed state.

Thus, it will be understood that in the first position 103, the flap 92 is free to move in response to pressure but in the second position, the flap is raised away from aperture 90 independent of any excess pressure but in response to the removal of the electrical signal from the dishwasher timer.

As will be understood in the art, the wax motor 104 may be replaced with other electrical actuators including but not limited to solenoids and motors and that the signal from the dishwasher may be either a current or lack of current as is necessary for correct operation of the vent 22.

The above description has been that of a preferred embodiment of the present invention, it will occur to those that practice the art that many modifications may be made without departing from the spirit and scope of the invention. In order to apprise the public of the various embodiments that may fall within the scope of the invention, the following claims are made.

We claim:

1. In a dishwasher providing a sealable volume containing dishes during their washing, a vent comprising:

a pressure actuable valve element movable between an open and closed state and positioned to block the passage of air from the sealable volume to outside the dishwasher in the closed state and to allow the passage of air from the sealable volume to outside the dishwasher in the open state, the pressure acutable valve element moving from the closed to the open state in response to a predetermined excess of air pressure in the sealable volume over the air pressure outside the dishwasher; and an electrical actuator movable between a first and second position and linked with the pressure actuable valve element so as allow free movement of the pressure actuable valve element between the open and closed state in response to the predetermined excess of pressure, when the electric actuator is in the first position and to hold the pressure actuable valve element in the open state when the electric actuator is in the second position;

whereby absent an signal from the dishwasher actuating the electric actuator and absent excess of pressure in the sealable volume, noise emanating from the sealable volume is blocked.

2. The vent as recited in claim 1 wherein the predetermined excess of pressure is less than one inch of water.

3. The vent as recited in claim 1 wherein the electric actuator is a wax motor.

4. In a dishwasher providing a sealable volume containing dishes during their washing, a vent comprising:

an electrically actuable valve positioned to block the passage of air from the sealable volume to outside the dishwasher in a closed state and to allow the passage of air from the sealable volume to outside the dishwasher in an open state, the electrically acutable valve moving between the open and closed state in response to an electrical signal; and a pressure actuable valve positioned to block the passage of air from the sealable volume to outside the dishwasher in a closed state and to allow the passage of air from the sealable volume to outside the dishwasher in an open state, the pressure acutable valve moving from the open to the closed state in response to a predetermined excess of air pressure in the sealable volume over the air pressure outside the dishwasher;

whereby absent an electrical signal from the dishwasher to the electrically actuable value and an excess of pressure in the sealable volume, noise emanating from the sealable volume is blocked.

5. The vent as recited in claim 4 wherein the predetermined excess of pressure is less than one inch of water.

6. The vent as recited in claim 4 wherein the pressure acutable valve includes a caged ball seatable against a circular aperture leading between the sealable volume and outside the dishwasher.

7. The vent as recited in claim 4 wherein the pressure acutable valve includes at least one flap hinged to movably cover at least one aperture leading between the sealable volume and outside the dishwasher.

8. The vent as recited in claim 7 wherein the pressure actuable valve includes at least two elastomeric flaps covering two apertures.

9. The vent as recited in claim 4 wherein the electrically acutable valve includes a wax motor moving a valve element to cover and uncover an aperture leading between the sealable volume and outside the dishwasher.

10. The vent as recited in claim 4 including a common housing providing a first opening to the sealable volume and a second opening to outside the dishwasher, the first and second openings separate by a wall having a first and second apertures;

wherein the electrically acutable valve is positioned to block and allow that passage of air through the first aperture and wherein the pressure actuable valve is positioned to block and allow the passage of air through the second aperture.

11. The vent as recited in claim 10 including further a second wall opposed to the first apertures and having a third apertures and wherein the electrically actuable valve includes a flexible boot having a valve surface sized to block the first apertures when the electrically actuable valve is actuated to block the first aperture, the flexible boot having sidewalls extending from the valve surface to an edge attached to the third apertures;

whereby remaining portions of the electrically actuable valve are shielded from contact with materials from the sealable volume of the dishwasher.

* * * * *